US007887050B2

(12) United States Patent
Trudeau et al.

(10) Patent No.: US 7,887,050 B2
(45) Date of Patent: Feb. 15, 2011

(54) RIGHT ANGLE TURN (RAT) MODULE FOR CONVEYING MAILPIECE COLLATIONS

(76) Inventors: Joseph A. Trudeau, 28 Taft Cir., Watertown, CT (US) 06796; Michael R. Ifkovits, 8 Elmar Dr., Danbury, CT (US) 06811; Edward M. Ifkovits, 2 Schermerhorn Dr., New Fairfield, CT (US) 06812; Joseph F. Zuzick, Jr., 3 W. Knollwood Ter., Shelton, CT (US) 06484

( * ) Notice: Subject to any disclaimer, the term of this patent is extended or adjusted under 35 U.S.C. 154(b) by 204 days.

(21) Appl. No.: 12/188,334

(22) Filed: Aug. 8, 2008

(65) Prior Publication Data

US 2010/0032894 A1 Feb. 11, 2010

(51) Int. Cl.
*B65H 29/00* (2006.01)
*B65G 47/24* (2006.01)

(52) U.S. Cl. ..... 271/186; 271/185; 271/184; 198/412

(58) Field of Classification Search ..... 271/225, 271/240, 184–186; 198/411, 412
See application file for complete search history.

(56) References Cited

U.S. PATENT DOCUMENTS 3,476,384 A * 11/1969 Oderman et al. ..... 271/184
4,527,792 A * 7/1985 Burkhardt ..... 271/225
4,705,157 A * 11/1987 Bowles ..... 198/405
5,333,851 A * 8/1994 Kulpa ..... 271/225
5,451,040 A * 9/1995 Crabtree ..... 271/10.11
6,409,008 B1 * 6/2002 Newsome ..... 198/403
6,540,223 B2 * 4/2003 Keane et al. ..... 271/178
6,688,593 B1 * 2/2004 Auerbach ..... 271/184
7,036,654 B2 * 5/2006 Frost ..... 198/406
7,234,696 B2 * 6/2007 Focke et al. ..... 271/185
7,510,183 B2 * 3/2009 Edwards et al. ..... 271/186
2004/0021261 A1 * 2/2004 Auerbach ..... 271/2
2004/0164483 A1 * 8/2004 Focke et al. ..... 271/264
2009/0166959 A1 * 7/2009 Ito ..... 271/225

* cited by examiner

*Primary Examiner*—Stefanos Karmis
*Assistant Examiner*—Patrick Cicchino
(74) *Attorney, Agent, or Firm*—Brian A. Collins; Steve Shapiro; Charles R. Malandra, Jr.

(57) ABSTRACT

A Right Angle Turn (RAT) module for processing multi-sheet collations includes opposed belt segments defining a conveyance channel for capturing multi-sheet collations therebetween and for conveying multi-sheet collations from an input and to an output end of the conveyance channel. The opposed belt segments define a first re-directing bend, a second re-directing bend, and a twist section disposed therebetween. The first re-directing bend includes a rolling element for re-directing the opposed belt segments about a first axis of rotation while the second re-directing bend includes a rolling element for re-directing the opposed belt segments about a second axis of rotation. The first and second axes of rotation are orthogonal to each other so as to effect a twist section therebetween. The RAT module additionally includes a mechanism for driving the opposed belt segments about the first and second re-directing bends to convey the multi-sheet collations from the input to output ends and effect a right angle turn of the multi-sheet collations.

20 Claims, 7 Drawing Sheets

RIGHT ANGLE TURN (RAT) MODULE FOR CONVEYING MAILPIECE COLLATIONS

TECHNICAL FIELD

The present invention relates to apparatus for conveying sheet material, and more particularly, to a new and useful Right Angle Turn (RAT) module which is operative to re-direct a collation of sheet material from an upstream module to a downstream module of a mailpiece fabrication device.

BACKGROUND OF THE INVENTION

Mailpiece creation systems such as mailpiece inserters are typically used by organizations such as banks, insurance companies, and utility companies to periodically produce a large volume of mailpieces, e.g., monthly billing or shareholders income/dividend statements. In many respects, mailpiece inserters are analogous to automated assembly equipment inasmuch as sheets, inserts and envelopes are conveyed along a feed path and assembled in or at various modules of the mailpiece inserter. That is, the various modules work cooperatively to process the sheets until a finished mailpiece is produced.

While the exact configuration of each mailpiece inserter depends upon the needs of a particular customer/installation, a mailpiece inserter will frequently employ modules for re-directing the feed path, e.g., ninety degrees, to accommodate the configuration of a customer's facility. More specifically, a mailpiece inserter may employ one or more Right Angle Turn (RAT) modules to produce an L- or U-shaped inserter feed path. In this way, the various inserter modules, together with the in-process mailpieces, are accessible to the operator(s) which may be centrally located within the bounded area of the inserter.

A RAT module typically comprises one or more roller assemblies, i.e., a drive and idler roller pair, disposed at an acute angle relative to the direction of the feed path upon receipt by the roller(s). Generally, the roller assembly is disposed at an angle of approximately forty-five (45) degrees such that the sheet material will enter the module by contacting the peripheral surface of the roller assembly along a first line of tangency, i.e., to one side of the drive roller, and exit the module after being driven about the peripheral surface of the drive roller, to a second line of tangency along the other side thereof. Consequently, the sheet material is redirected ninety (90) degrees.

While RAT modules of the prior art have proven successful and reliable for re-directing individual sheets of material, i.e., a single sheet of material captured between the drive and idler rollers, such modules are significantly less effective and/or reliable when re-directing multi-sheet collations. That is, when passing multiple sheets of material through a RAT module of the prior art, the sheets exhibit a propensity to skew, become misaligned, and/or do not maintain edge registration. Consequently, difficulties arise when inserting such collations into a mailpiece envelope. Specifically, insertion becomes difficult when attempting to fill an envelope with a collation which is skewed inasmuch as the internal side edges of the envelope pocket are no longer parallel to the side edges of the collation. Furthermore, when edge registration of the individual sheets of a collation is not maintained, i.e., are misaligned, the sheet collation may be oversized as compared to the pocket dimension of the envelope. Consequently, the envelope cannot be filled.

A need, therefore, exists for a Right Angle Turn (RAT) module which is capable of re-directing mailpiece collations while maintaining alignment of the multi-sheet collation, both in terms of sheet registration and skewing of the sheet collation relative to the receiving envelope.

SUMMARY OF THE INVENTION

A Right Angle Turn (RAT) module is disclosed for processing multi-sheet collations in a mailpiece fabrication device. The RAT module includes opposed belt segments defining a conveyance channel for capturing multi-sheet collations therebetween and for conveying multi-sheet collations from an input and to an output end of the conveyance channel. The opposed belt segments defining a first re-directing bend, a second re-directing bend and a twist section disposed therebetween. The first re-directing bend includes a rolling element for re-directing the opposed belt segments about a first axis of rotation while the second re-directing bend includes a rolling element for re-directing the opposed belt segments about a second axis of rotation. The first and second axes of rotation are orthogonal to each other so as to effect a twist section therebetween. The RAT module additionally includes a mechanism for driving the opposed belt segments about the first and second re-directing bends to convey the multi-sheet collations from the input to output ends and effect a right angle turn of the multi-sheet collations.

DETAILED DESCRIPTION OF THE INVENTION

The present invention will be described in the context of a mailpiece inserter for re-directing sheet material through a right angle, or ninety-degree turn. Furthermore, the invention is generally applicable to any sheet material handling device such as may be used in the fabrication of mailpieces, e.g., sorters, facer/cancellers, feeders, etc. That is, the Right Angle Turn (RAT) module of the present invention is described in the context of a mailpiece inserter merely for illustration purposes and should not be construed as limiting the scope of the appended claims.

Figure 1:
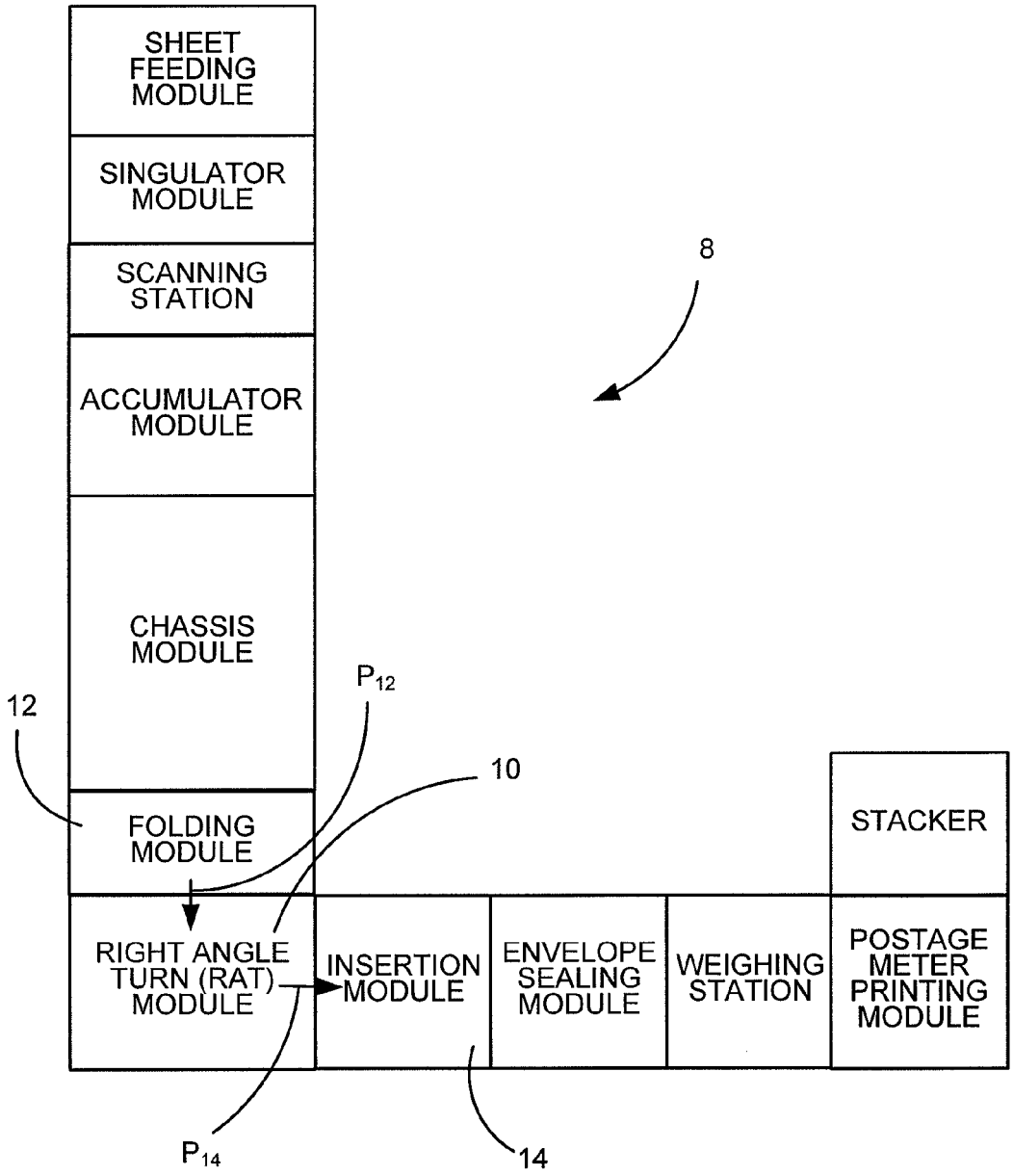
FIG. 1 is a schematic view of a portion of a mailpiece inserter including a Right Angle Turn (RAT) module according to the present invention interposed between an upstream module and a downstream module of the mailpiece inserter.

In FIG. 1, a mailpiece inserter 8 includes a RAT module 10 of the present invention interposed between an upstream module 12 and a downstream module 14. The modules 12, 14 are arranged such that the respective feed paths for conveying sheet material 20 are orthogonal, i.e., at right angles to each other. As previously discussed in the Background of the Invention, this arrangement of the various stations/modules 12, 14 may be influenced by the available space requirements of a customer and/or may be advantageous for ease of operator access to the various inserter modules. In the described embodiment, the upstream module 12 may be a folding module operative to fold a sheet material collation stack sheet material. The downstream module 14 may be any one of a variety of system stations/modules including an insertion module operative to insert a folded sheet collation into a mailpiece envelope. The function of the upstream and downstream modules 12 and 14 are irrelevant to the structure and function of the present invention, except that the feed paths and for conveying sheet material (denoted by arrows $P_{12}$ and $P_{14}$) are at right angles, i.e., orthogonal, to each other.

Figure 2:
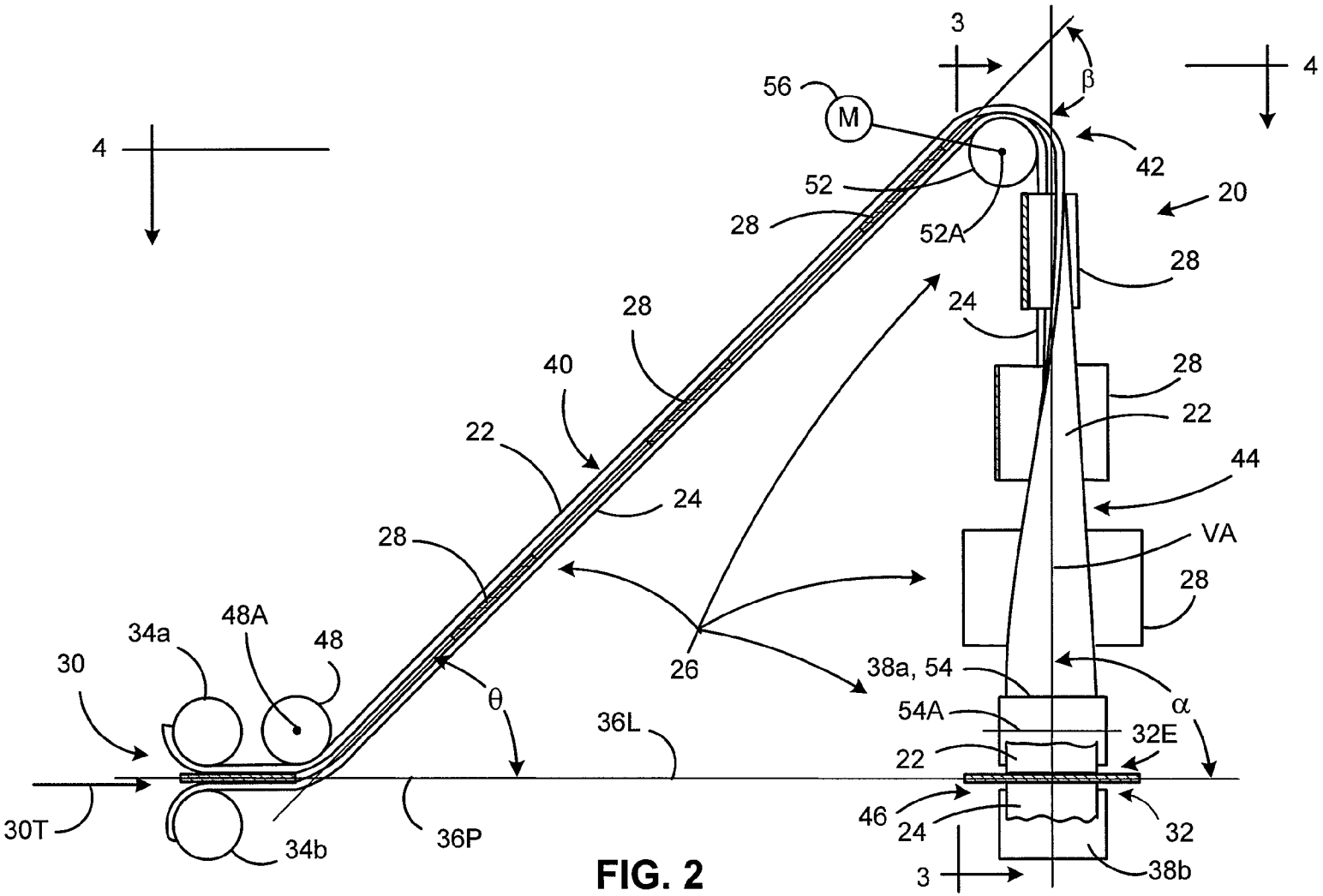
FIG. 2 is a profile view of the relevant portions of a Right Angle Turn (RAT) module according to the teachings of the present invention including opposed belt segments defining a channel for conveying a multi-sheet collation through first and second re-directing bends and a twist section disposed between the re-directing bends.
Figure 3:
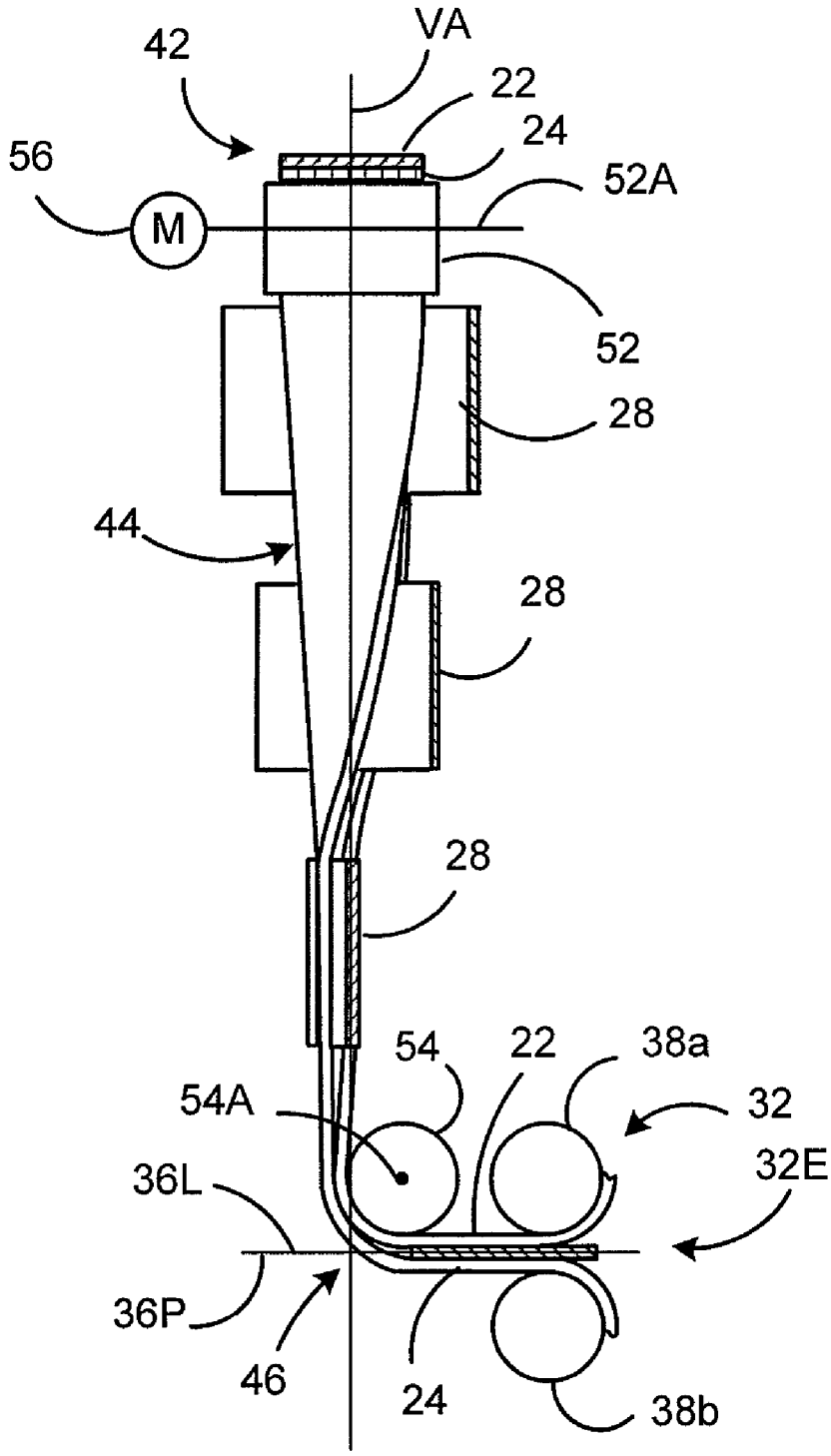
FIG. 3 is a view taken substantially along line 3-3 of FIG. 2 to more fully illustrate the conveyance channel and the capability to re-direct the multi-sheet collation through a ninety-degree turn, i.e., from the input to output ends of the RAT module.
Figure 4:
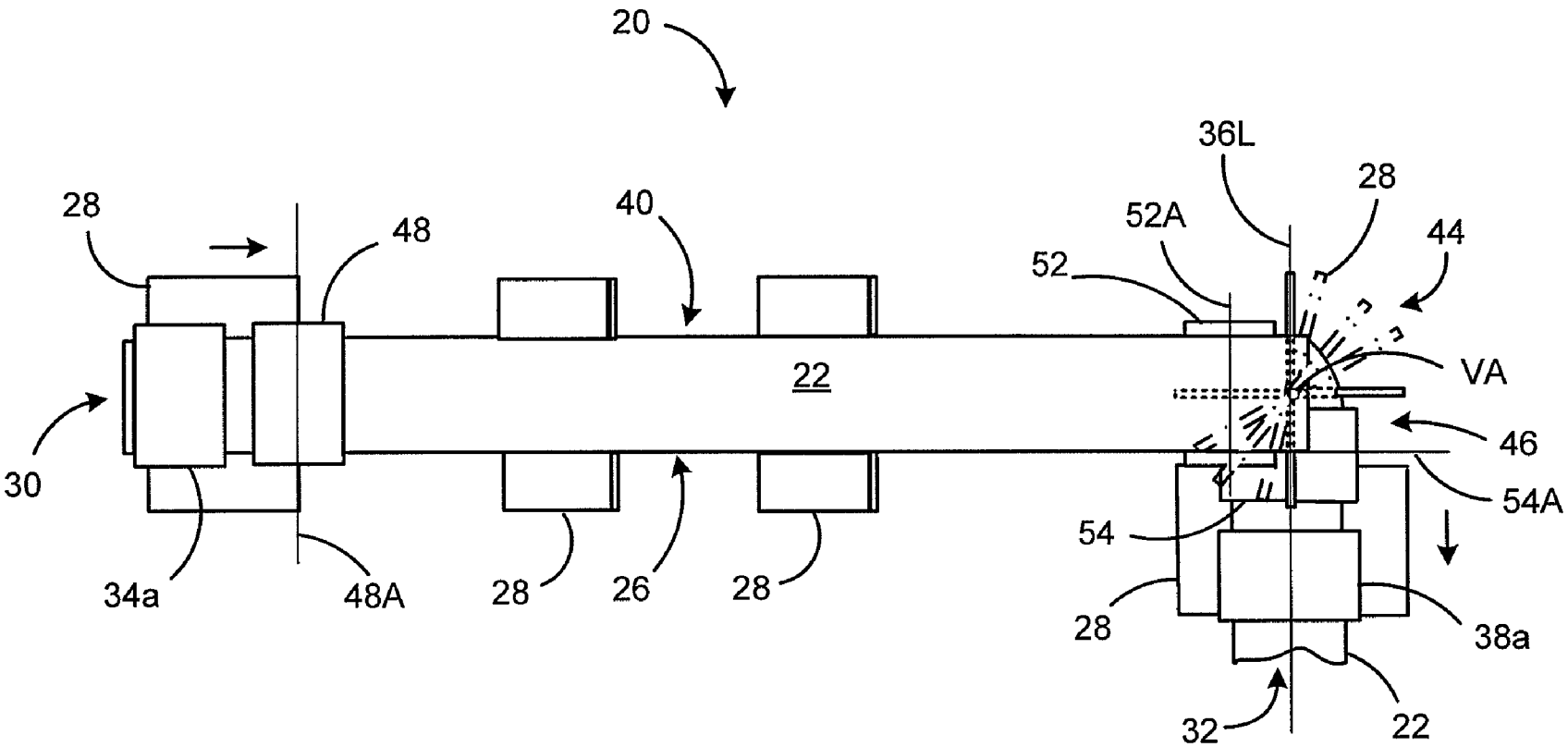
FIG. 4 is a top view taken substantially along line 4-4 of FIG. 2 to more fully illustrate the utility of the twist section to re-direct the multi-sheet collation through the ninety-degree turn of the RAT module.

In FIGS. 2, 3 and 4, the RAT module 10 includes opposed belt segments 22, 24 which define a channel 26 therebetween for conveying a multi-sheet collation 28 from an input end 30 to an output end 32. The opposed belt segments 22, 24 are formed from a urethane material and have a high coefficient of static friction, i.e., sufficient to capture and convey multi-sheet collations without slippage or inadvertent displacement. In the context used herein, the phrase "opposed belts" are intended to describe the orientation and face-to-face relation of a conveyance belt rather than a meaning which implies a plurality of belts. In fact, the invention contemplates the use of both (i) a single continuous belt which is recurved to define the conveyance channel 26 and (ii) a pair of belts, each forming a continuous loop, which cooperates to form the conveyance channel 26. This aspect of the invention will be described in subsequent paragraphs. Furthermore, while each of the opposed belt segments 22, 24 are shown as being broken away at the input and output ends 32, it should be appreciated that the belts 22, 24 complete a continuous closed loop, whether individually or in combination, and are driven by a conventional rotary drive mechanism. The mechanism for driving the opposed belt segments 22, 24 and mechanism for synchronizing the rate of displacement, or speed, of each will also be discussed in further detail hereinafter.

The input end 30 is defined by a first pair of rolling elements 34*a*, 34*b* which, in combination with the belts 22, 24, form an input throat 30T for receiving the multi-sheet collation 28, e.g., from the upstream module 12. The output end 32 is similarly defined by a second pair of rolling elements 38*a*, 38*b* which, in combination with the belts 22, 24, define an exit interface 32E for conveying the multi-sheet collation 28 to the downstream module 14. Furthermore, in the described embodiment, the input and output ends 30, 32 and, consequently, the throat 30T and exit interface 32E, are essentially coincident and co-planar, along line 36L and plane 36P. It should be appreciated, however, that input and output ends 30, 32 may differ in elevation and alignment.

In addition to the rolling elements 34*a*, 34*b*, 38*a*, 38*b* associated with the input and output ends 30, 32, the opposed belt segments 22, 24 are disposed over and guided by various additional rolling elements to define an inclined section 40, a first re-directing bend 42, a vertical twist section 44 and a second re-directing bend 46. More, specifically, a rolling element 48 rotates about an axis of rotation 48A to direct the opposed belt segments 22, 24 up the inclined section 40 toward the first re-directing bend 42. In the described embodiment, the inclined section 40 defines an acute angle θ of about forty-five (45) degrees, though this angle may vary depending upon the available space within the RAT module 10.

The first re-directing bend 42 is effected by a rolling element 52 having a first axis of rotation 52A which redirects the opposed belt segments 22, 24 and, the course/direction of the sheet collation 28. The first re-directing bend 42, furthermore, re-directs the opposed belt segments 22, 24, and the course/direction of the sheet collation, over an obtuse angle β of about one-hundred and thirty-five (135) degrees. Furthermore, the first re-directing bend 42 directs the opposed belt segments 22, 24, vertically downwardly toward the second re-directing bend 46. Moreover, the axis of rotation 48A is substantially parallel to the rotational axis 52A such that opposed belt segments 22, 24, and consequently, the sheet collation 28, are not skewed or twisted along the inclined section 40 of the conveyance channel 26.

Before continuing with our discussion of the conveyance channel 26, it should be appreciated that the inclined section 40 is incorporated to maintain the input and output ends 30, 32 at the same elevation, i.e., co-planar. The acute angle θ introduced by the inclined section 40 necessitates that the first re-directing bend 42 introduce an obtuse angle β to direct the sheet collation 28 vertically downward. However, depending upon the desired location of the input and output ends 30, 32, the inclined section 40 may be eliminated in its entirety such that the first re-directing bend 42 need only introduce an angle β of ninety (90) degrees, i.e., a right angle, to direct the opposed belt segments 22, 24, and the sheet collation 28, vertically downward.

The second re-directing bend 46 is effected by a rolling element 54 having an second axis of rotation 54A which is orthogonal, i.e., at right angles, and lies in a parallel plane parallel to, the first rotational axis 52A associated with the rolling element 52 of the first re-directing bend 42. Furthermore, the rotational axis 52A, 54A are substantially vertically aligned along a vertical axis VA. As a consequence of the orthogonal and vertical orientation of the axes 52A, 54A, the opposed belt segments 22, 24 are vertically twisted from the first to the second re-directing bends 42, 46 of the conveyance channel 26. Accordingly, the orientation of the axes 52A, 54A produces the vertical twist section 44 which is aligned with the vertical axis VA of the conveyance channel 26. Finally, the second re-directing bend 46 changes the direction of the opposed belt segments 22, 24 by an additional (90) degrees, i.e., a right angle.

In operation, the conveyance channel 26 re-directs the sheet collations 28 by ninety (90) degrees as they travel from the input to output ends 30, 32 of the channel 26. More specifically, the opposed belt segments 22, 24 are driven in the same direction and at the same speed to prevent misalignment of each multi-sheet collation 28. The mechanism for driving the opposed belt segments 22, 24 may include any conventional rotary drive mechanism 56 (see FIGS. 2 and 3) mounting to and driving one or more of the rolling elements 34*a*, 34*b*, 38*a*, 38*b*, 48, 52, 54. In the illustrated embodiment, the rotary drive mechanism 56 drives rolling element 52, however, other rolling elements (not shown) which are part of and complete the closed-loop of the belts 22, 24 i.e., may also be employed to drive the belts 22, 24. As will be discussed hereinbelow, the belts 22, 24 may comprise two individually driven belts or a single continuous belt.

The sheet collations 28 are introduced into the throat 30T of the conveyance channel 28, i.e., at the input end 30 thereof.

Each sheet collation 28 is captured between the opposed belt segments 22, 24 at a midsection thereof, i.e., about a centroid of the respective sheet collation 28, such that equal portions of the sheet collation 28 project beyond each side of the opposed belt segments 22, 24. The sheet collations 28 travel up the inclined section 40 and around the first re-directing bend 42. As the sheet collations 28 are conveyed from the first to the second re-directing bends 42, 46, the twist section 44 causes each sheet collation 28 to rotate ninety-degrees about the vertical axis VA of the twist section 44. To complete the right angle turn, the sheet collations 28 travel around the second re-directing bend 46 and out the exit interface 32E of the conveyance channel 26.

Figure 5:
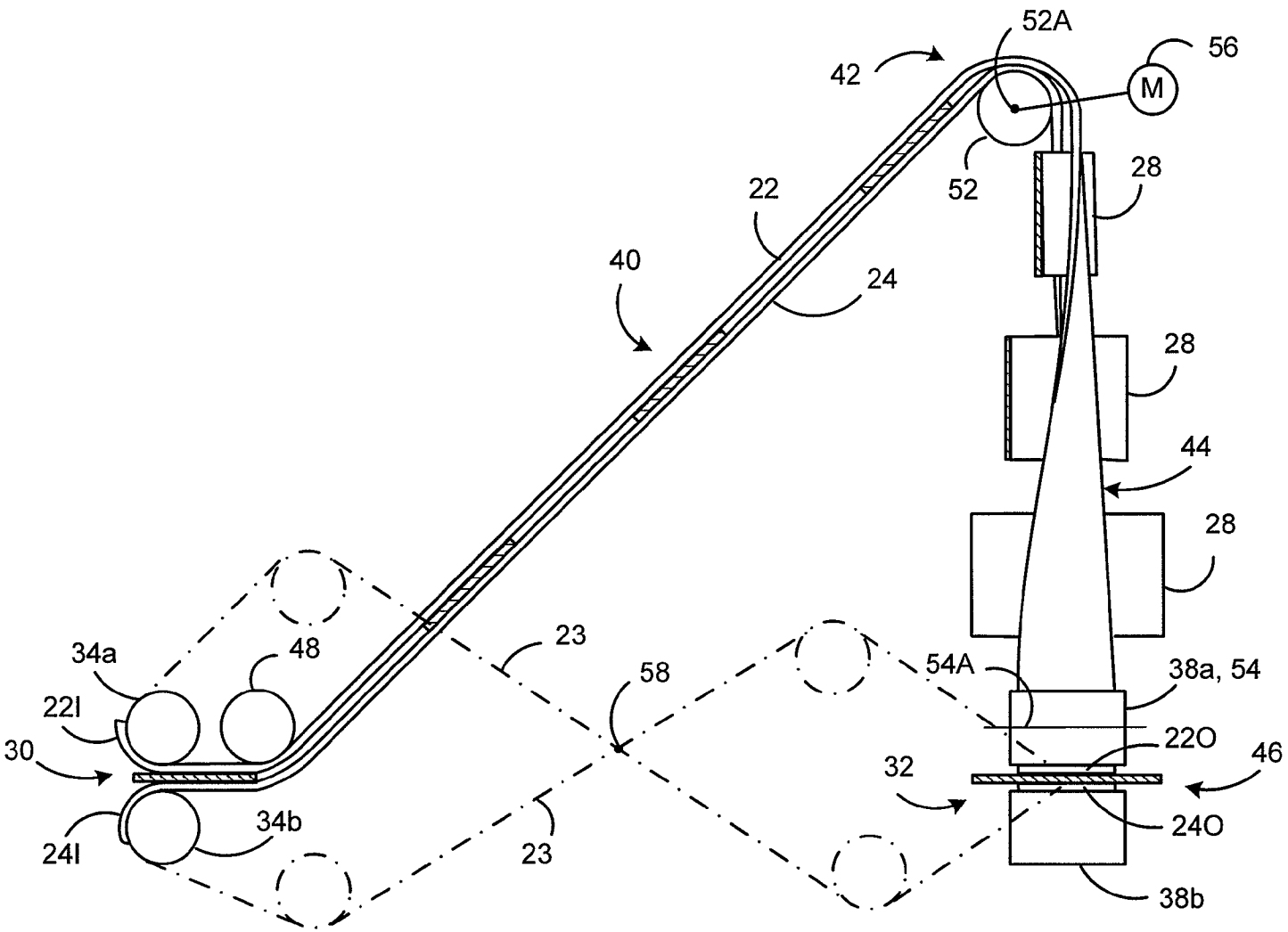
FIG. 5 depicts an alternate embodiment of the present invention wherein a single conveyance belt synchronizes the opposed belt segments of the conveyance channel to prevent misalignment of the sheet collation.

In an alternate embodiment of the invention shown in FIG. 5, the RAT module 10 may include a single conveyance belt for synchronizing the opposed belt segments 22, 24 and preventing misalignment of a sheet collation 28. When employing a single conveyance belt, the belt is curved back, or must cross-over, from the input to the output ends 30, 32 to form multiple loops such as those seen in a figure-eight configuration. More specifically, the conveyance channel 26 and opposed belt sections 22, 24 are formed by connecting the output ends 220, 240 of one of the belt sections 22, 24 to the input ends 221, 241 of an opposing one of the belt sections 22, 24. To achieve this configuration, a connecting portion 23, shown in dashed lines between the belt sections 22, 24 must cross over at least one of the belt sections so as to produce the cross-over/multi-loop configuration. Each connecting portion 23 must extend laterally to a side of the belt sections 22, 24, i.e., via rolling elements which move the respective connecting portion 23 away from the belt sections 22, 24. At the "crossing juncture" 58, the connecting portion 23 and belt sections 22, 24, must be sufficiently distal or separate to allow passage of the sheet collations 28, i.e., without contacting the respective connecting portion 23.

Figure 6:
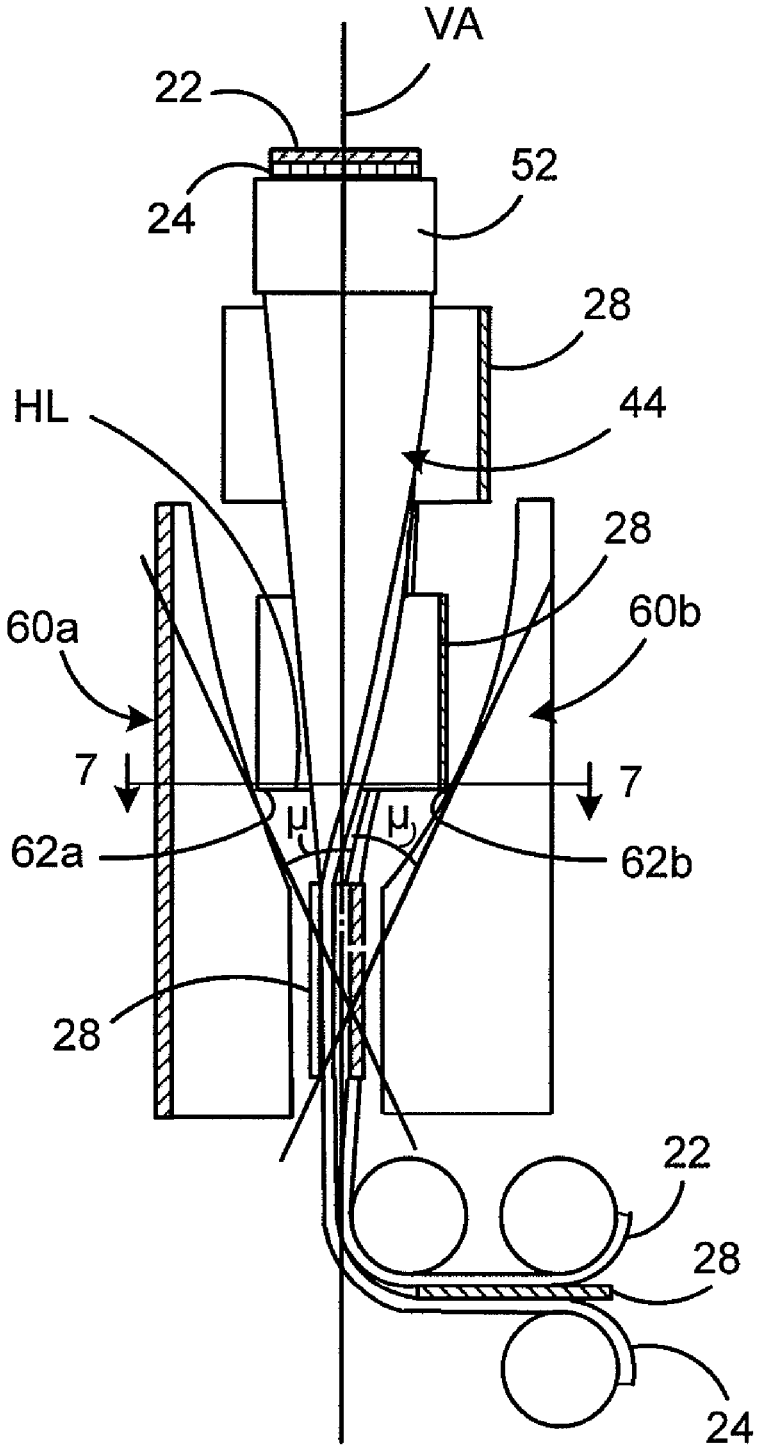
FIG. 6 depicts another alternate embodiment of the present invention wherein a pair of anti-skew guides is disposed laterally of the conveyance channel to guide the multi-sheet collation through the twist section of the conveyance channel and prevent skewing of the sheet collation.
Figure 7:
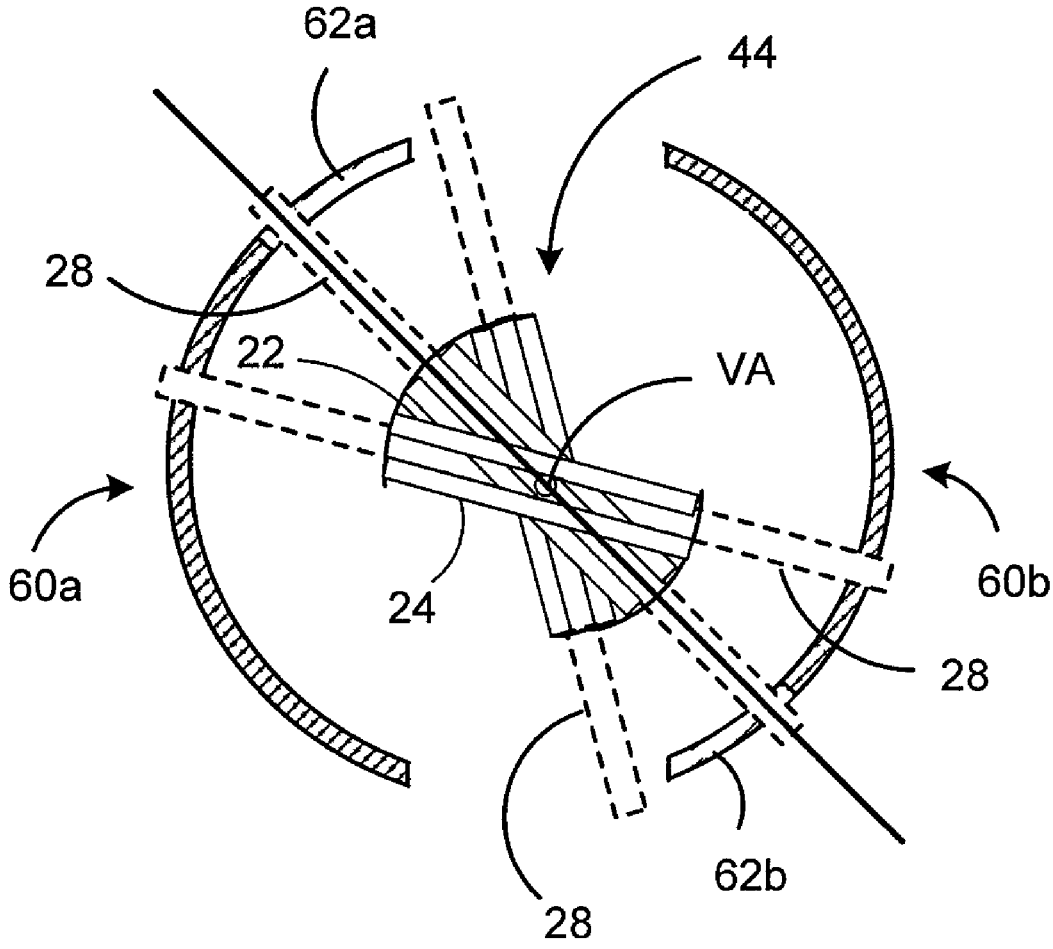
FIG. 7 depicts a sectional view taken substantially along line 7-7 of FIG. 6.

FIGS. 6 and 7 depict yet another embodiment of the present invention wherein anti-skew guides 60*a*, 60*b* are disposed on each side of the conveyance channel 26 to guide each multi-sheet collation 28 through the twist section 44 and prevent skewing of the sheet collations 28. More specifically, each of the anti-skew guides 60*a*, 60*b* includes a spiral-shaped guide surface 62*a*, and 62*b*, respectively, which define acute angles μ with respect to the vertical axis VA along the twist section 44. Furthermore, each of the spiral-shaped guide surfaces 62*a*, 62*b* are opposing such that an acute angle μ is formed on opposing sides of the vertical axis VA. In the sectional view of FIG. 7, each of the anti-skew guides 60*a*, 60*b* inscribes an arc of between about 60 degrees to about 120 degrees about the vertical axis VA of the twist section 44. Finally, the spiral-shaped guide surfaces 62*a*, 62*b* jointly intersect a line HL which additionally intersects, and is orthogonal to, the vertical axis VA of the twist section 44. The line HL corresponds to, and is indicative of, a leading edge portion of each sheet collation 28 as it traverses the twist section 44 of the conveyance channel 26.

In operation, the spiral-shaped guide surfaces 62*a*, 62*b* of the anti-skew guides 60*a*, 60*b* are operative to contact the leading edge of each sheet collation 28 to maintain alignment of the sheet collation 28 and facilitate subsequent insertion thereof into a mailpiece envelope. For example, if a sheet collation 28 is skewed as it enters the twist section 44, one of the laterally projecting portions of the sheet collation 28, i.e., a portion extending to one side of the opposed belt segments 22, 24, will present a first leading edge portion which contacts one of the spiral-shaped guide surfaces 62*a*, 62*b*. Should the first leading edge portion contact one of the spiral-shaped guide surfaces 62*a*, 62*b* before a second leading edge portion, i.e., to the other side of the opposed belt segments 22, 24, the guide surfaces 62*a*, 62*b* will have the effect of correcting a misalignment which may have been introduced by the RAT module 10. For example, should the first leading edge portion of the sheet collation 28 contact one of the spiral-shaped guide surfaces 62*a*, 62*b* before the second leading edge portion contacts the other of the spiral-shaped guide surfaces 62*a*, 62*b*, the sheet collation 28 will rotate until both the first and second leading edge portions are in contact with the guide surfaces 62*a*, 62*b*. As such, the sheet collation 28 will be properly aligned for receipt by the downstream inserter module 14, i.e., for subsequent insertion into a mailpiece envelope. That is, the sheet collation 28 may be squarely inserted within the mailpiece envelope such that the side edges of the sheet collation 28 remain parallel to, and aligned with, the corresponding internal edges of the mailpiece envelope.

In summary, the RAT module 10 of the present invention provides a reliable and efficient device for re-directing multi-sheet mailpiece collations 28. The RAT module 10 maintains alignment of the multi-sheet collations 28 though the use of anti-skew guides 60*a*, 60*b* and opposed belt segments 22, 24 formed by a single conveyance belt. Specifically, the anti-skew guides 60*a*, 60*b* employ spiral-shaped guide surfaces 62*a*, 62*b* disposed to each side of the conveyance channel 26 to maintain alignment of the leading edge of the sheet collation 28 as it traverses downwardly along the twist section 44 of the conveyance channel 26. As a result, the multi-sheet collation 28 may be squarely inserted into a mailpiece envelope. Furthermore, the RAT module 10 may employ a single conveyance belt to positively synchronize the motion of each of the opposed belt segments 22, 24. That is, a single conveyance belt driven by a common drive mechanism eliminates the potential for one of the belt segments 22, 24 to be driven at a different rate of displacement than the other of the belt segments 22, 24.

It is to be understood that all of the present figures, and the accompanying narrative discussions of preferred embodiments, do not purport to be completely rigorous treatments of the methods and systems under consideration. For example, while the invention describes an interval of time for completing a phase of sorting operations, it should be appreciated that the processing time may differ. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, methods of escorting and storing individual mailpieces and in various configurations which need not be further elaborated herein.

The invention claimed is:

1. A right angle turn module for processing multi-sheet collations, comprising:

opposed belt segments defining a conveyance channel for capturing multi-sheet collations therebetween and for conveying multi-sheet collations from an input end to an output end of the conveyance channel, the opposed belt segments defining:

a first re-directing bend including a rolling element for re-directing the opposed belt segments about a first axis of rotation;

a second re-directing bend including a rolling element for re-directing the opposed belt segments about a second axis of rotation; the first and second axes of rotation being orthogonal and lying in a parallel plane so as to effect a twist section therebetween;

an anti-skew guide having a spiral-shaped guide surface for engaging a leading edge portion of a multi-sheet collation to maintain a desired orientation thereof for alignment of the multi-sheet collation and subsequent insertion into a mailpiece envelope; and a mechanism for driving the opposed belt segments about the first and second re-directing bends to convey the multi-sheet collations from the input to output ends and effect a right angle turn of the multi-sheet collations.

2. The right angle turn module according to claim 1 further comprising an inclined section disposed between the input end and the first re-directing bend to effect a co-planar spatial relationship between the input and output ends.

3. The right angle turn module according to claim 1 wherein the opposed belt segments include a pair of belts, each of the belts forming a continuous loop and cooperating to define the conveyance channel.

4. The right angle turn module according to claim 1 wherein the opposed belt segments include a single continuous belt which is recurved to define the conveyance channel.

5. The right angle turn module according to claim 4 wherein the conveyance belt crosses over from the input to the output ends to form a multiple loop configuration.

6. The right angle turn module according to claim 5 wherein each of the opposed belt sections includes an input and output end, and wherein the conveyance belt is arranged by connecting the output ends of one of the belt sections to the input ends of an opposing one of the belt sections.

7. The right angle turn module according to claim 1 wherein the spiral-shaped guide surface circumscribes the twist section of the conveyance channel.

8. A right angle turn module for a mailpiece inserter, the right angle turn module operative to process multi-sheet collations, comprising:

opposed belt segments defining a conveyance channel for capturing multi-sheet collations therebetween and for conveying multi-sheet collations from an input end to an output end of the conveyance channel, the opposed belt segments defining an inclined section, a first re-directing bend, a second re-directing bend and a twist section disposed between the first and second re-directing bends;

the inclined section operative to raise the elevation of the multi-sheet collation from the input end to the first re-directing bend and maintain a substantially co-planar spatial relationship with respect to the input and output ends;

the first re-directing bend including a rolling element for re-directing the opposed belt segments about a first axis of rotation;

the second re-directing bend including a rolling element for re-directing the opposed belt segments about a second axis of rotation; the first and second axes of rotation being orthogonal to each other to effect the twist section therebetween;

an anti-twist guide circumscribing the twist section and including a spiral-shaped guide surface operative to engage a leading edge portion of each multi-sheet collation and maintain alignment of the multi-sheet collation for subsequent insertion into a mailpiece envelope; and a mechanism for driving the opposed belt segments about the first and second re-directing bends to convey the multi-sheet collations from the input to output ends and effect a right angle turn of the multi-sheet collations.

9. The right angle turn module according to claim 8 wherein the opposed belt segments include a pair of belts, each of the belts forming a continuous loop and cooperating to define the conveyance channel.

10. The right angle turn module according to claim 8 wherein the opposed belt segments include a single continuous belt which is recurved to define the conveyance channel.

11. The right angle turn module according to claim 10 wherein the conveyance belt crosses over from the input to the output ends to form a multiple loop configuration.

12. The right angle turn module according to claim 11 wherein each of the opposed belt sections includes an input and output end, and wherein the conveyance belt is arranged by connecting the output ends of one of the belt sections to the input ends of an opposing one of the belt sections.

13. The right angle turn module according to claim 2 wherein the input and output ends are coincident.

14. The right angle turn module according to claim 8 wherein the input and output ends are coincident.

15. The right angle turn module according to claim 1 wherein the twist section is disposed along a substantially vertical axis and wherein each of the first and second rotational axes are substantially aligned with the vertical axis.

16. The right angle turn module according to claim 8 wherein the twist section is disposed along a substantially vertical axis and wherein each of the first and second rotational axes are substantially aligned with the vertical axis.

17. A method for re-directing multi-sheet collations in a mailpiece creation device; comprising the steps of:

capturing a multi-sheet collations between opposed belt segments, the opposed segments defining a conveyance channel;

re-directing the opposed belt segments over a first rolling element having a first axis of rotation;

re-directing the opposed belt segments over a second rolling element having a second axis of rotation, the second rolling element re-directing the opposed belt segments through an angle $\alpha$;

arranging the first and second rotational axes of the first and second rolling elements in a parallel plane and at right angles to effect a twist section between the first and second rolling elements;

driving the opposed belt segments about the first and second rolling elements to convey the multi-sheet collations from an input end to and output end of the conveyance channel and effect a right angle turn of the multi-sheet collation; and guiding a leading edge portion of the multi-sheet collation about an anti-skew guide having spiral-shaped guide surfaces to prevent skewing of the multi-sheet collation.

18. The method according to claim 17 wherein the opposed belts comprise a single continuous conveyance belt and further comprising the step of arranging the conveyance belt such that an input end of one of the opposed belt sections connects to an output end of the other one of the opposed belt sections.

19. The method according to claim 17 further comprising the step of elevating the opposed belts via an inclined section between the input end and the first rolling element such that the input and output ends are substantially co-planar.

20. The method according to claim 19 wherein the first rolling element re-directs the opposed belt segments through an angle $\beta$, wherein the second rolling elements directs the opposed belt segments through an angle $\alpha$, wherein the angle $\beta$ is between ninety-degrees and one-hundred and thirty five degrees, and wherein the angle $\alpha$ is at least ninety degrees.

* * * * *